US012723824B2

(12) United States Patent
Kim et al.

(10) Patent No.: US 12,723,824 B2
(45) Date of Patent: Sep. 1, 2026

(54) HEAT EXCHANGER AND HEAT EXCHANGER MANUFACTURING METHOD

(71) Applicant: LG ELECTRONICS INC., Seoul (KR)

(72) Inventors: Hongseong Kim, Seoul (KR); Seungmo Jung, Seoul (KR); Sungwoo Kim, Seoul (KR); Hanchoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 532 days.

(21) Appl. No.: 18/036,510

(22) PCT Filed: Nov. 11, 2021

(86) PCT No.: PCT/KR2021/016464
§ 371 (c)(1),
(2) Date: May 11, 2023

(87) PCT Pub. No.: WO2022/103178
PCT Pub. Date: May 19, 2022

(65) Prior Publication Data

US 2024/0011721 A1 Jan. 11, 2024

(30) Foreign Application Priority Data

Nov. 12, 2020 (KR) ..... 10-2020-0151052

(51) Int. Cl.
*F28F 1/12* (2006.01)
*F28F 9/02* (2006.01)

(52) U.S. Cl.
CPC ..... *F28F 1/126* (2013.01); *F28F 9/02* (2013.01)

(58) Field of Classification Search
CPC .. F28F 2220/00; F28F 1/12; F28F 1/18; F28F 1/16; F28F 1/126; F28F 9/02;
(Continued)

(56) References Cited

U.S. PATENT DOCUMENTS

2005/0051315 A1* 3/2005 Ozaki ..... F28F 9/0226 165/173
2008/0169085 A1 7/2008 Oh et al.

FOREIGN PATENT DOCUMENTS

JP 2001194088 A * 7/2001 ..... F28F 9/0224
JP 2002206889 7/2002
(Continued)

OTHER PUBLICATIONS

Korean Office Action dated Jul. 15, 2025, issued in Application No. 10-2020-0151052.
(Continued)

*Primary Examiner* — Harry E Arant
(74) *Attorney, Agent, or Firm* — KED & ASSOCIATES, LLP

(57) ABSTRACT

The present invention relates to a heat exchanger comprising: a plurality of fin tubes which have heat transfer fins integrally formed with tubes in which a refrigerant flows; and a header which is coupled to the respective one end portions of the plurality of fin tubes. The header may comprise: a header main body which has one side opened; and a sheet which is disposed on the open one side of the header main body, has formed therein a plurality of slits having the respective one end portions of the plurality of fin tubes respectively inserted therein, and forms a plurality of corrugated portions by being bent into a corrugated shape. Accordingly, the respective one ends of the fin tubes are inserted into the sheet having the corrugated portions formed, and then the corrugated portions of the sheet are compressed, thereby enabling the narrowing of gaps
(Continued)

between the fin tubes and the header, and thus, by increasing tight adhesion between the fin tubes and the sheet, tolerance may be reduced, and a leakage of the refrigerant may be reduced. In addition, when inserting the fin tubes, intervals between the corrugated portions formed on the sheet are widened so as to enable the fin tubes to be easily inserted, and thus an advantage is also achieved of enabling easy product assembly.

16 Claims, 14 Drawing Sheets

(58) Field of Classification Search
CPC .. F28F 9/0224; F28F 2255/02; F28F 2275/04; F28F 2275/14; F28D 1/05366; F28D 1/05333; F28D 2021/0068; B21D 53/02; B21D 53/85
See application file for complete search history.

(56) References Cited

FOREIGN PATENT DOCUMENTS

| | | |
|---|---|---|
| JP | 2004-219044 | 8/2004 |
| KR | 10-2006-0028809 | 4/2006 |
| KR | 10-0644135 | 11/2006 |
| KR | 20-0432601 | 12/2006 |
| KR | 10-2007-0064938 | 6/2007 |
| KR | 10-2009-0038359 | 4/2009 |
| KR | 20-2007-0017024 | 4/2009 |
| KR | 10-1447072 | 10/2014 |
| KR | 10-2016-0015627 | 2/2016 |
| KR | 10-2019-0096216 | 8/2019 |
| KR | 10-2019-0097632 | 8/2019 |

OTHER PUBLICATIONS

International Search Report dated Mar. 15, 2022 issued in Application No. PCT/KR2021/016464.

* cited by examiner

HEAT EXCHANGER AND HEAT EXCHANGER MANUFACTURING METHOD

CROSS-REFERENCE TO RELATED PATENT APPLICATIONS

This application is a U.S. National Stage Application under 35 U.S.C. § 371 of PCT Application No. PCT/KR2021/016464, filed Nov. 11, 2021, which claims priority to Korean Patent Application No. 10-2020-0151052, filed Nov. 12, 2020, whose entire disclosures are hereby incorporated by reference.

TECHNICAL FIELD

The present disclosure relates to a heat exchanger and a method of manufacturing the same. More particularly, the present disclosure relates to a heat exchanger with improved product assemblability and reduced brazing defect rate by including a header with a sheet having a plurality of corrugated portions and into which a fin tube is inserted, and a method of manufacturing the heat exchanger.

BACKGROUND ART

A heat exchanger can be generally used as a condenser or an evaporator in a refrigeration cycle device including a compressor, a condenser, an expansion device, and an evaporator. Also, a heat exchanger can be installed in an air conditioner, a refrigerator, or the like to exchange heat between a refrigerant and air.

A heat exchanger can be classified into a finned tube type heat exchanger, a microchannel type heat exchanger, and the like. The heat exchanger may include a plurality of tubes through which refrigerant flows to exchange heat with external air, a fin coupled to the plurality of tubes to increase the heat exchange capability, and a header in communication with the plurality of tubes to supply refrigerant.

Meanwhile, in the related art, an insertion hole is formed on one surface of a header through slotting processing or wire cutting and then a tube is inserted into the insertion hole.

For example, Korean Patent Registration No. 10-0644135, which is hereby incorporated by reference, discloses a header having a plurality of insertion holes to which end portions of tubes are coupled.

However, in the case of a heat exchanger of the related art, a gap between a header and a fin tube is increased due to tolerances generated when manufacturing the fin tube and machining an insertion hole corresponding to the shape of the fin tube, causing the high defect rate of brazing.

In addition, the related art heat exchanger is disadvantageous in that the structural stability of coupling between components is low.

Also, the related art heat exchanger is not suitable for the assembly of a header and a fin tube, due to a numerous number of fin tubes passing through insertion holes and a narrow interval between the insertion holes.

Examples of the related art include Korean Patent Registration No. 10-0644135 (published on Nov. 10, 2006), Korean Utility Model Publication No. 20-2007-0017024 (published on Apr. 27, 2009), Korean Utility Model Registration No. 20-0432601 (published on Dec. 5, 2006), Korean Patent Registration No. 10-1447072 (published on Oct. 6, 2014), and Korean Laid-Open Patent Publication No. 10-2019-0097632 (published on Aug. 21, 2019).

DISCLOSURE OF INVENTION

Technical Problem

It is an objective of the present disclosure to provide a heat exchanger with a decreased gap between a fin tube and a header, and a reduced brazing defect rate.

It is another objective of the present disclosure to provide a heat exchanger with improved structural coupling stability between a fin tube and a header.

It is yet another objective of the present disclosure to provide a heat exchanger that can facilitate the assembly of a fin tube and a header.

The objectives of the present disclosure are not limited to the objectives described above, and other objectives not stated herein will be clearly understood by those skilled in the art from the following description.

Technical Solution

According to an aspect of the subject matter described in this application, a heat exchanger includes: a plurality of fin tubes each comprising a fin for heat transfer and a tube through which refrigerant flows, the fin and the tube being integrally formed with each other; and a header coupled to one end portions of the plurality of fin tubes. The header may include: a header body open at one side; and a sheet disposed on the open one side of the header body, having a plurality of slits into which the one end portions of the plurality of fin tubes are respectively inserted, and bent into a corrugated shape to define a plurality of corrugated portions.

As one end of the fin tube is into the sheet having the corrugated portion and then the corrugated portion of the sheet is compressed, a gap between the header and the fin tube may be reduced to thereby increase adhesion between the sheet and the fin tube, allowing tolerance and refrigerant leakage to be reduced. In addition, the fin tube may be easily inserted by increasing an interval between the corrugated portions formed on the sheet, thereby facilitating the product assembly.

The plurality of slits may extend in a direction intersecting a direction in which the plurality of corrugated portions are arranged.

The plurality of slits may extend in a direction perpendicular to the direction in which the plurality of corrugated portions are arranged.

The plurality of corrugated portions may include: a plurality of crest portions and a plurality of trough portions alternately arranged with each other; a plurality of flat portions formed at intervals between the plurality of crest portions and the plurality of trough portions in an inclined manner. The plurality of slits may extend along the plurality of crest portions and/or the plurality of trough portions.

As the fin tube inserted into the slit receives pressure in a direction in which the sheet is compressed, adhesion between the sheet and the fin tube may be improved, allowing airtightness to be achieved, refrigerant leakage to be prevented, and structural stability to be ensured.

A pair of flat portions, formed adjacent to a slit among the plurality of slits, may face opposite surfaces of one end portion of one of the plurality of fin tubes inserted into the slit.

Each of the plurality of slits may be formed on one of the plurality of crest portions. When a portion between each trough portion and each flat portion is defined as a boundary portion, the boundary portion may be in contact with one end portion of a fin tube, among the plurality of fin tubes, inserted into one of the plurality of slits.

The sheet may be configured such that the plurality of corrugated portions are compressible in a direction in which the plurality of corrugated portions are arranged. A pitch between the plurality of trough portions may decrease when the sheet is compressed.

The one end portions of the plurality of fin tubes may be inserted at least as deep as a thickness of the sheet.

The plurality of slits may each include: a fin slit portion into which the fin is inserted; and a tube slit portion into which the tube is inserted.

The sheet may include a groove extending from the tube slit portion along the corrugated shape of the sheet and recessed to surround the tube inserted into the tube slit portion.

At least a portion of the groove may be in close contact with the tube.

The header body may be provided with a first recess recessed from an inner surface thereof to extend in a first direction and guiding insertion of the sheet in the first direction.

The first direction may be a direction in which the plurality of corrugated portions are arranged.

Since the sheet is inserted into the first recess and is compressed in a direction in which the plurality of corrugated portions are arranged, the sheet may preferably be inserted into the first recess in the direction in which the plurality of corrugated portions are arranged.

The first recess may include: a sheet insertion hole connected to an outside so as to allow the sheet to be inserted from the outside; and a sheet guide recess extending from the sheet insertion hole in the first direction and guiding insertion of the sheet.

The sheet insertion hole may have a shape that gradually narrows toward a direction in which the sheet is inserted.

Accordingly, even when the sheet is inserted into the first recess while the sheet is not in a correct position, the sheet may be guided to the correct position to thereby facilitate the insertion of the sheet into the first recess.

The header may include a header cover coupled to one end portion of the header body to be in contact with one end portion of the sheet.

The header body may be provided with a second recess recessed from an inner surface thereof to extend in a second direction and guiding insertion of the header cover in the second direction.

The second direction may be a direction perpendicular to a direction in which the plurality of corrugated portions are arranged.

Accordingly, although the sheet compressed in one direction applies pressure to the header cover while being stretched in another direction, the header cover may be securely fixed to thereby achieve the structural stability.

A side surface and a lower surface of the header cover may extend in the second direction. The header cover may include a cover edge portion formed between the side surface and the lower surface of the header cover and extending in a rounded shape from the lower surface of the header cover to the side surface of the header cover.

The second recess may include: a cover insertion hole connected to an outside so as to allow the header cover to be inserted from the outside; and a cover guide recess extending from the cover insertion hole in the second direction and guiding insertion of the header cover.

The cover insertion hole may have a shape that gradually narrows toward a direction in which the header cover is inserted.

Accordingly, even when the header cover is inserted into the second recess while the header cover is not in a correct position, the header cover may be guided to the correct position to allow the header cover to be easily inserted into the second recess.

A gap between the sheet and each fin tube may be brazed with a filler metal.

According to another aspect of the subject matter described in this application, a method of manufacturing a heat exchanger is provided. The method may include: placing a sheet having a plurality of corrugated portions and a plurality of slits formed along the plurality of corrugated portions on one open side of a header body to be longer than a length of the header body; inserting one end portions of a plurality of fin tubes into the plurality of slits; and compressing the plurality of corrugated portions in a longitudinal direction of the sheet to allow the sheet to be drawn into the header body.

The method may further include, after the sheet is drawn into the header body, coupling a header cover to a side surface portion of the header body.

The method may further include brazing a gap between the sheet and each fin tube with a filler metal.

Details of other embodiments are included in the detailed description and the accompanying drawings.

Advantageous Effects

A heat exchanger and a method of manufacturing the heat exchanger according to embodiments of the present disclosure have one or more of the following effects.

First, by inserting one end of a fin tube into a sheet having a corrugated portion and then compressing the corrugated portion of the sheet, a gap between the fin tube and a header may be reduced to thereby improve the quality of brazing and prevent refrigerant leakage.

Second, the structural stability of a coupling structure may be improved by compressing a sheet into which a fin tube is inserted and pressing the fin tube.

Third, as a pitch of a sheet having a corrugated portion is produced to be relatively large, a fin tube may be easily inserted into the sheet to thereby improve the assemblability.

The effects of the present disclosure are not limited to the effects described above, and other effects not mentioned will be clearly understood by those skilled in the art from the claims.

MODE FOR INVENTION

Figure 1:
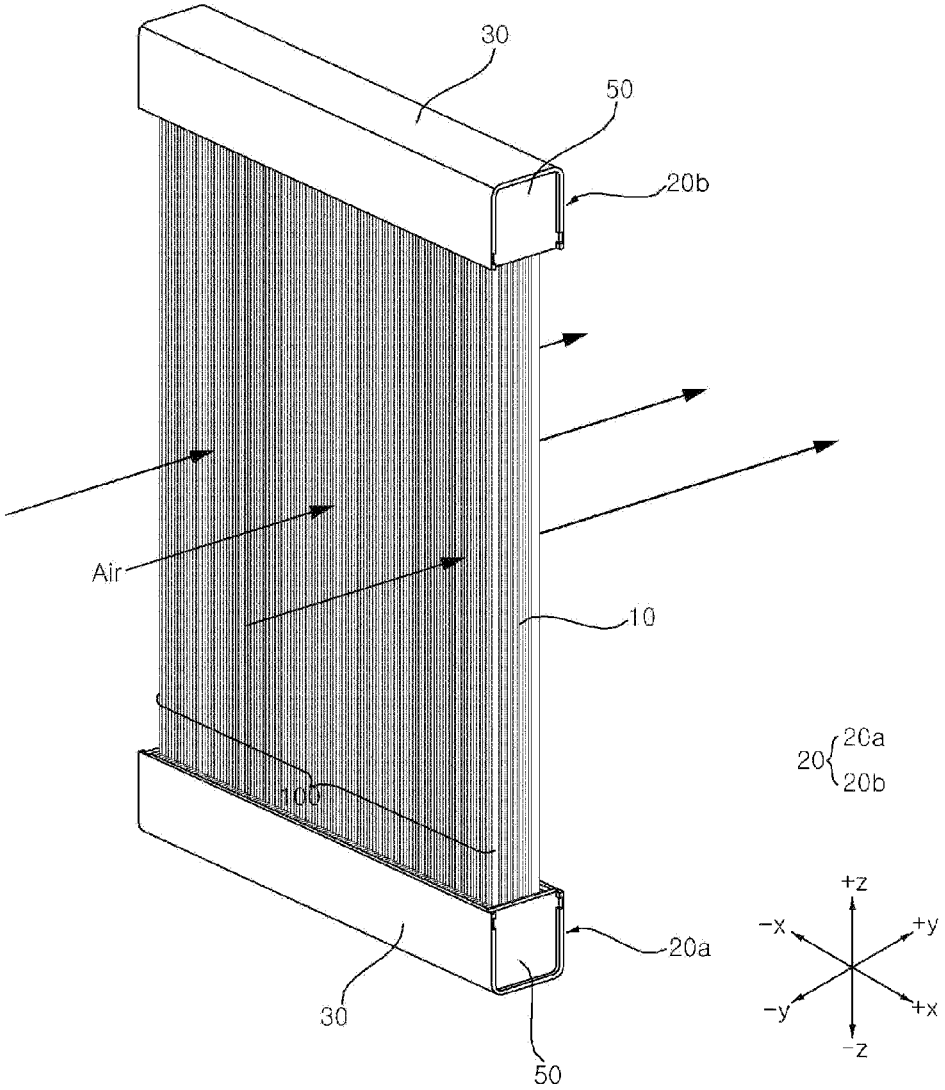
FIG. 1 is a perspective view of a heat exchanger according to an embodiment of the present disclosure.

The above and other aspects, features and other advantages of the present disclosure will be more clearly understood from the following detailed description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Spatially relative terms, such as, "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated at other orientations) and the spatially relative terms used herein interpreted accordingly.

The terminology used herein is for the purpose of describing particular embodiments only and is not intended to limit the full scope of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, and/or operations, but do not preclude the presence or addition of one or more other components, steps, and/or operations.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

In the drawings, the thickness or size of each component is exaggerated, omitted, or schematically shown for the sake of convenience and clarity. Also, the size and area of each component do not entirely reflect the actual size or area thereof.

Hereinafter, a heat exchanger according to embodiments of the present disclosure will be described with reference to the accompanying drawings.

In the following description, with respect to FIGS. 1 to 11, all areas (or joints) where insertion, coupling, fitting, contact, joining, or assembly is made between two or more components of the heat exchanger may be formed by brazing. A filler metal may be added to all areas where insertion, coupling, fitting, contact, joining, or assembly is made between two or more components of the heat exchanger. The heat exchanger may be put into a furnace with a filter metal being added thereto and then be exposed to a high-temperature condition for a certain period of time to be brazed. The description related to the brazing will be omitted below.

Hereinafter, the directions of the heat exchanger and its components according to embodiments of the present disclosure will be defined based on the coordinate system shown in FIGS. 1 to 13.

The x-axis direction may be defined as the front-and-rear direction. Based on the origin, the +x axis direction may be the front direction, and the −x axis direction may be the rear direction. The y-axis direction may be defined as the left-and-right direction. Based on the origin, the +y axis direction may be the right direction, and the −y axis direction may be the left direction. The z-axis direction may be defined as the up-and-down direction. Based on the origin, the +z axis direction may be the up direction, and the −z axis direction may be the down direction.

Referring to FIG. 1, the heat exchanger according to an embodiment of the present disclosure may include a fin tube 10 and a header 20.

The fin tube 10 may extend in the up-and-down direction. The fin tube 10 may be configured such that a fin 101 for heat transfer and a tube 102 through which refrigerant flows are integrally formed with each other (see FIG. 7). The fin tube 10 may be provided in plurality arranged in one direction. A plurality of fin tubes 100 may be spaced apart from one another to be arranged side by side. The plurality of fin tubes 100 may be disposed along a longitudinal direction of the header 20 to be coupled to the header 20.

The header 20 may be coupled to at least one end portions of the plurality of fin tubes 100. The header 20 may be coupled to each of both end portions of the plurality of fin tubes 100. The header 20 may be hollow to have therein a space 301 (see FIG. 3) through which refrigerant flows. The space 301 formed in the header 20 may be in communication with the plurality of fin tubes 100. The header 20 may include a refrigerant inlet (not shown) through which refrigerant is introduced and a refrigerant outlet (not shown) through which refrigerant is discharged.

The header 20 may include a second header 20*b* coupled to one end portions of the plurality of fin tubes 100 and a first header 20*a* coupled to another (or opposite) end portions of the plurality of fin tubes 100.

The first header 20*a* may be disposed on the lower side of the plurality of fin tubes 100, and may be coupled to the one end portions of the plurality of fin tubes 100. The first header 20*a* may be connected to the refrigerant outlet (not shown).

The second header 20*b* may be disposed on the upper side of the plurality of fin tubes 100, and may be coupled to the another end portions of the plurality of fin tubes 100. The second header 20*b* may be connected to the refrigerant inlet (not shown).

Refrigerant may flow into a space 301 in the second header through the refrigerant inlet (not shown). The refrigerant introduced into the second header 20*b* may flow into a space 301 in the first header 20*a* through the plurality of fin tubes 100. The refrigerant introduced into the first header 20*a* may be discharged to the outside through the refrigerant outlet (not shown).

When refrigerant is flowing in the plurality of fin tubes 10, air may exchange heat with the refrigerant while passing between the plurality of fin tubes 10.

Hereinafter, for the sake of convenience, the header 20 will be described based on the first header 20*a*, and the second header 20*b* may have the same shape, structure, and configuration as the first header 20*a*.

Figure 2:
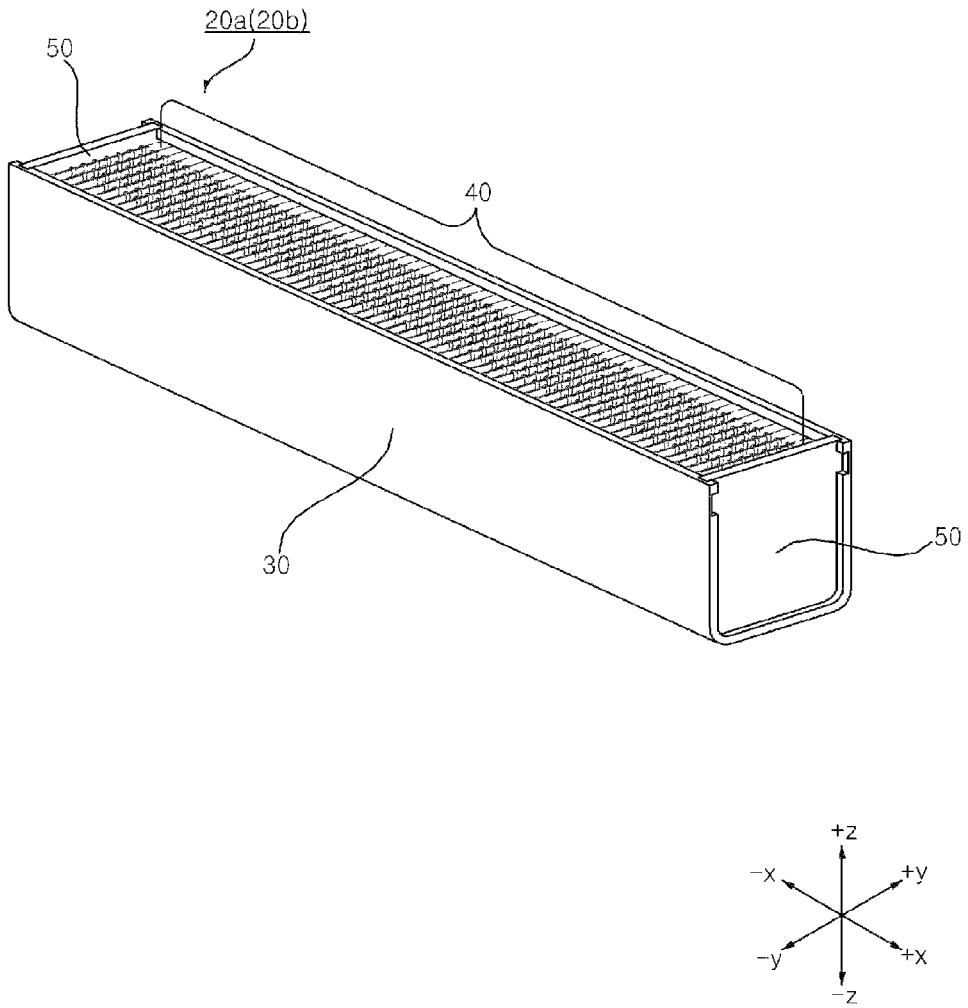
FIG. 2 is a perspective view of a header according to an embodiment of the present disclosure.

Referring to FIG. 2, the header 20 may include a header body 30, a header cover 50, and a sheet 40.

The header body 30 may have a hollow shape, so as to have therein the space 301 (see FIG. 3) through which refrigerant flows. One side or surface of the header body 30 may be open (see FIG. 3). An upper surface of the header body 30 may be open. Front and rear surfaces of the header body 30 may be open. The open surfaces of the header body 30 may be in communication with the space 301. The header body 30 may have a shape extending in one direction. The header body 30 may have a shape extending in the front-and-rear direction.

The sheet 40 may be disposed on the open one surface of the header body 30. The sheet 40 may be disposed on the open upper surface of the header body 30. The sheet 40 may shield the open one surface of the header body 30. The sheet 40 may be formed in a corrugated shape. The sheet may have an elongated shape extending in a longitudinal direction of the header body 30. The plurality of fin tubes 100 may be inserted into the sheet 40 (see FIG. 1).

The header cover 50 may define one side or surface of the header body 30. The header cover 50 may be coupled to one end portion of the header body 30. The header cover 50 may be coupled to a front end portion and/or a rear end portion of the header body 30. The header cover 50 may shield the open front surface and/or the rear surface of the header body 30.

The space 301 formed in the header 200 may be surrounded by the header body 30, the sheet 40, and the header cover 50 to be hermetically sealed from the outside.

Figure 3:
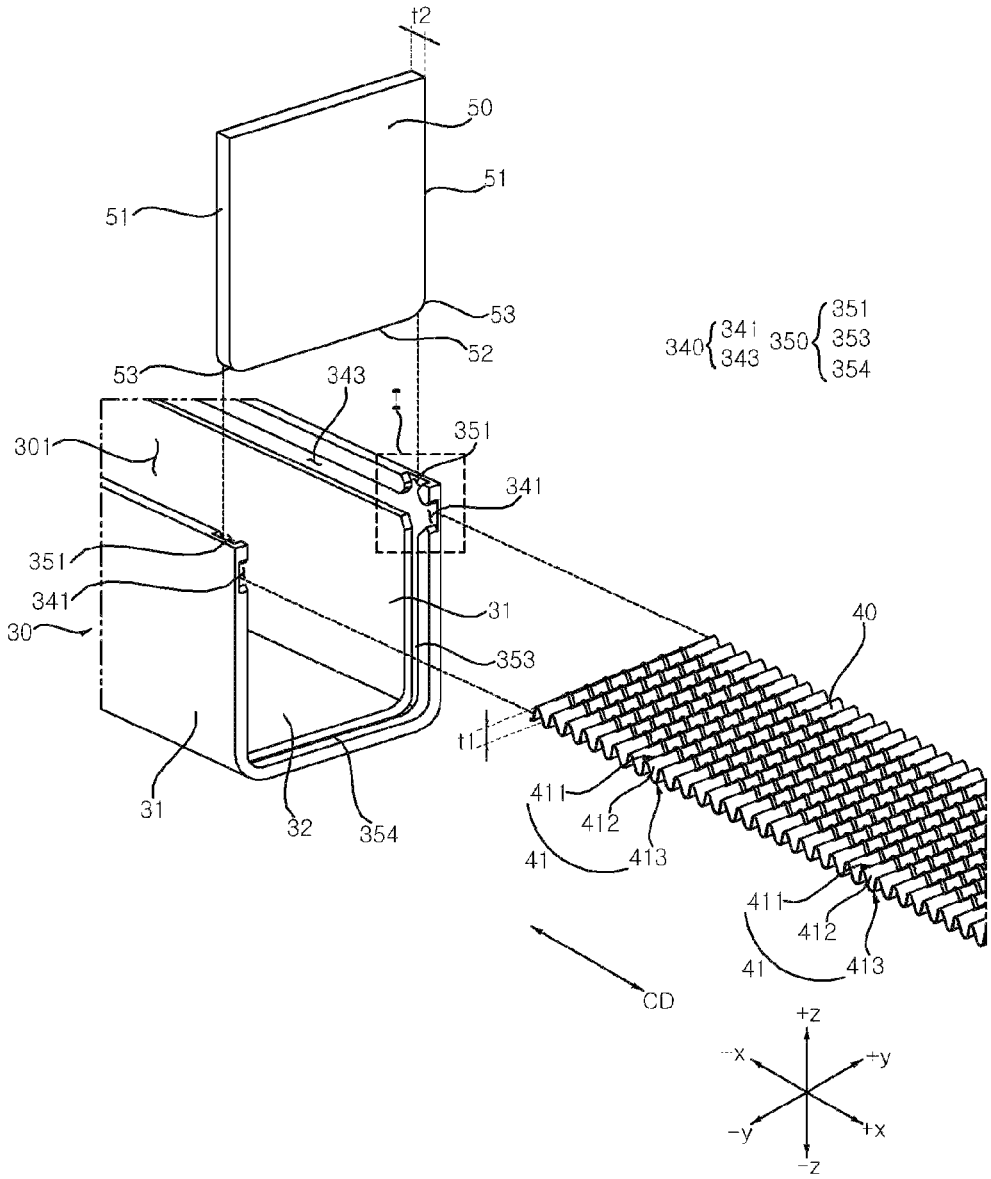
FIG. 3 is an exploded perspective view of a header and its components according to an embodiment of the present disclosure.
Figure 4:
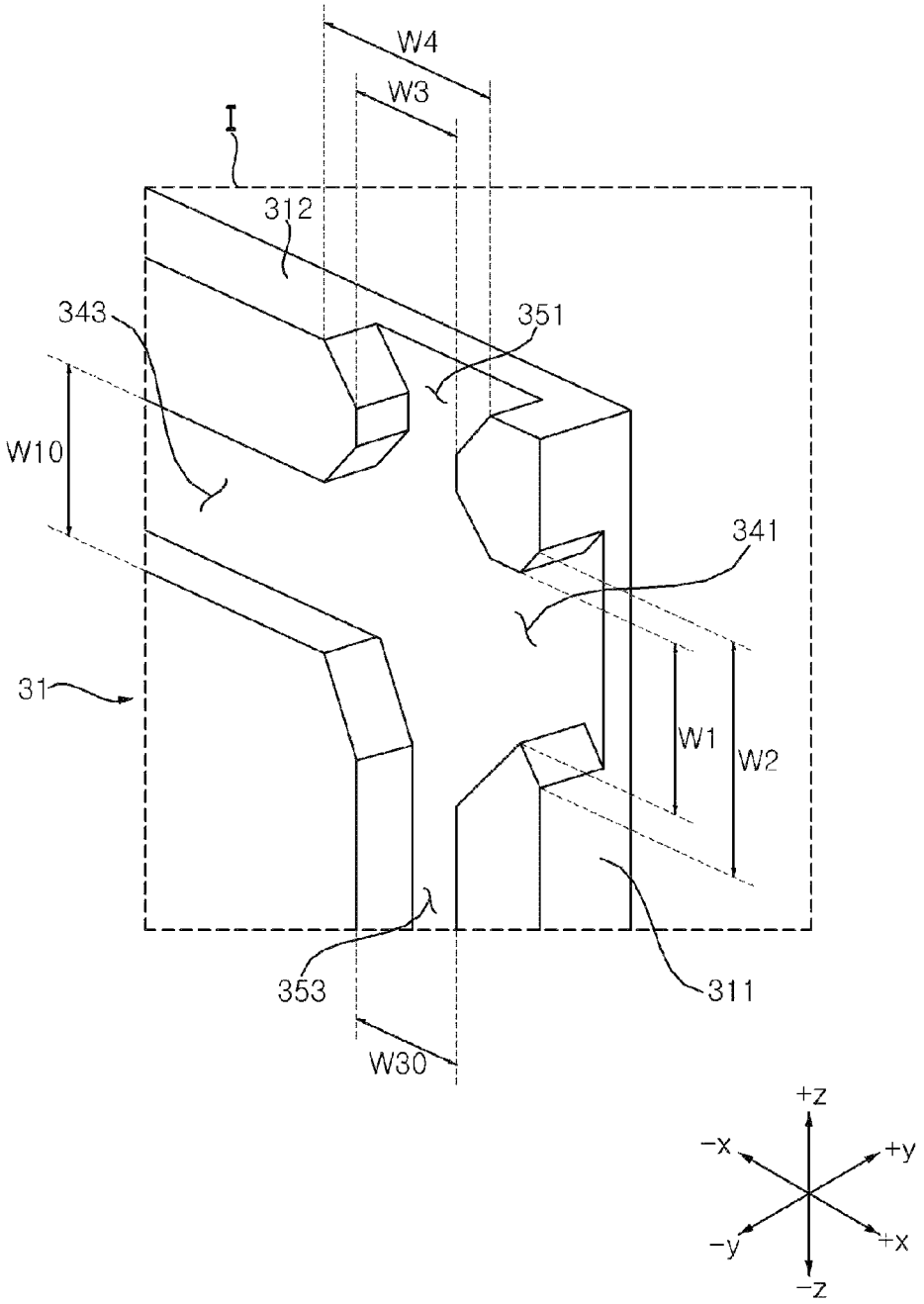
FIG. 4 is an enlarged view illustrating a portion of a component of the header shown in FIG. 3.

Referring to FIGS. 3 and 4, the header body 30 may include both side surfaces 31 and a lower surface 32 that surround the space 301. The upper surface of the header body 30 may be open. The front surface and/or the rear surface of the header body 30 may be open.

The sheet 40 may be bent into a corrugated shape. The sheet 40 may be bent into the corrugated shape to define a plurality of corrugated portions 41. The plurality of corrugated portions 41 may be arranged in a continuous manner in one direction to have the corrugated shape. The one direction may be referred to as a direction CD in which the plurality of corrugated portions 41 are arranged or a direction CD in which corrugation is formed. The sheet 40 may be elongated in the direction CD in which the plurality of corrugated portions 41 are arranged.

The sheet 40 may be configured to be changeable in length in the direction CD in which the plurality of corrugated portions 41 are arranged. The sheet 40 may be compressed or stretched along the direction CD in which the plurality of corrugated portions 41 are arranged. The sheet 40 may be made of a metal material having elasticity.

A first recess 340 may be formed in an inner part of the side surface 31 (hereinafter referred to as an "inner surface") of the header body 30. The first recess 340 may be formed in an upper portion of the inner surface of the header body 30. The first recess 340 may be recessed from the inner surface of the header body 30 to extend in a first direction. A pair of first recesses 340 may be provided on both side surfaces of the header body 30.

The sheet 40 may be inserted into the first recess 340 formed in the header body 30. The first recess 340 may guide insertion of the sheet 40 in the first direction.

The first direction may be the direction CD in which the plurality of corrugated portions 41 are arranged. The first recess 340 may extend in the direction CD in which the plurality of corrugated portions 41 are arranged. The first recess 340 may guide insertion of the sheet 40 in the direction CD in which the plurality of corrugated portions 41 are arranged.

As the sheet 40 is inserted into the first recess 340 and is compressed in the direction CD in which the plurality of corrugated portions 41 are arranged, the sheet 40 may preferably be inserted into the first recess 340 in the direction CD in which the plurality of corrugated portions 41 are arranged. In another example, the sheet 40 may be inserted into the first recess 340 in a direction perpendicular to the direction in which the plurality of corrugated portions 41 are arranged. The sheet 40 may be inserted into the first recess 340 in a direction in which a slit 42 (see FIGS. 5 and 6) extends.

The first recess 340 may include a sheet insertion hole 341 connected to the outside and a sheet guide recess 343 extending from the sheet insertion hole 341 in the first direction. The sheet insertion hole 341 may be formed at a front end 311 and/or a rear end (not shown) of the side surface 31 of the header body 30 to communicate with the outside. The sheet guide recess 343 may be connected to the sheet insertion hole 341, and may extend in the longitudinal direction of the header body 30.

The sheet 40 may be inserted from the outside to an inside of the header body 30 through the sheet insertion hole 341. After the sheet 40 is inserted into the sheet insertion hole 341 from the outside, insertion of the sheet may be guided along the sheet guide recess 343.

The sheet insertion hole 341 may have a shape that gradually narrows toward a direction in which the sheet 40 is inserted. A width of the sheet insertion hole 341 in the up-and-down direction may gradually decrease in the direction in which the sheet 40 is inserted.

At least a portion of a surface defining the sheet insertion hole 341 may be inclined so that the sheet insertion hole 341 gradually narrows. At least a portion of the surface defining the sheet insertion hole 341 may be rounded so that the sheet insertion hole 341 gradually narrows.

The sheet 40 may be sequentially inserted from an outside of the sheet insertion hole 341 to an inside of the sheet insertion hole 341. An inner width w1 of the sheet insertion hole 341 may be less than an outer width w2 of the sheet insertion hole 341. The inner width w1 of the sheet insertion hole 341 may be substantially the same as a thickness t1 of the sheet 40. The outer width w2 of the sheet insertion hole 341 may be greater than the thickness t1 of the sheet 40. A width w10 of the sheet guide recess 343 may be substantially the same as the inner width w1 of the sheet insertion hole 341.

The header cover 50 may be coupled to one end portion of the header body 30. The header cover 50 may be in contact with one end portion of the sheet 40. The header cover 50 may be provided in plurality, so as to be coupled to both end portions of the header body 30. A pair of header covers 50 may be in contact with both end portions of the sheet 40. The header cover 50 may be coupled to the front end portion and/or the rear end portion of the header body 30.

A second recess 350 may be formed on the inner surface of the header body 30. The second recess 350 may be recessed from the inner surface of the header body 30 to extend in a second direction. A pair of second recesses 350 may be provided on both side surfaces of the header body 30.

The second direction may be a direction perpendicular to the direction CD in which the plurality of corrugated portions 41 are arranged. For example, when the plurality of corrugated portions 41 are arranged in the front-and-rear direction, the second direction may be the up-and-down direction or the left-and-right direction.

The second recess 350 may include a cover insertion recess 354 formed on the lower surface of the header body 30. The cover insertion recess 354 may be connected to a cover guide recess 353. The cover insertion recess 354 may come in contact with a lower surface 52 of the header cover 50 guided by the cover guide recess 353 to thereby limit an insertion depth of the header cover 50.

The header cover 50 may be inserted into the second recess 350 formed in the header body 30. The second recess 350 may guide insertion of the header cover 50 in the second direction.

The header cover 50 may have a plate shape extending in the second direction. A side surface 51 and the lower surface 52 of the header cover 50 may extend in the second direction. The side surface 51 and the lower surface 52 of the header cover 50 may be perpendicular to each other. Both side surfaces 51 of the header cover 50 may extend in the up-and-down direction. The lower surface 52 of the header cover 50 may extend in the left-and-right direction.

The header cover 50 may include a cover edge portion 53. The cover edge portion 53 may be formed between the side surface 51 and the lower surface 52 of the header cover 50. The cover edge portion 53 may extend in a rounded shape from the lower surface 52 of the header cover 50 to the side surface 51 of the header cover 50.

The second recess 350 may include a cover insertion hole 351 connected to the outside and the cover guide recess 353 extending from the cover insertion hole 351 in the second direction. The cover insertion hole 351 may be formed at an upper end 312 of the side surface 31 of the header body 30 to communicate with the outside. The cover guide recess 353 may be connected to the cover insertion hole 351, and may extend in the up-and-down direction.

The header cover 50 may be inserted from the outside to the inside of the header body 30 through the cover insertion hole 351. After the header cover 50 is inserted into the cover insertion hole 351 from the outside, insertion of the header cover 50 may be guided along the cover guide recess 353.

The cover insertion hole 351 may have a shape that gradually narrows toward a direction in which the header cover 50 is inserted. A width of the cover insertion hole 351 in the front-and-rear direction may gradually decrease in the direction in which the header cover 50 is inserted.

At least a portion of a surface defining the cover insertion hole 351 may be inclined so that the cover insertion hole 351 gradually narrows. At least a portion of the surface defining the cover insertion hole 351 may be rounded so that the cover insertion hole 351 gradually narrows.

The header cover 50 may be sequentially inserted from an outside of the cover insertion hole 351 to an inside of the cover insertion hole 351. An inner width w3 of the cover insertion hole 351 may be less than an outer width w4 of the cover insertion hole 351. The inner width w3 of the cover insertion hole 351 may be substantially the same as a thickness t2 of the header cover 50. The outer width w4 of the cover insertion hole 351 may be greater than the thickness t2 of the header cover 50. A width w30 of the cover guide recess 353 may be substantially the same as the inner width w3 of the cover insertion hole 351.

The sheet insertion hole 341 and the cover insertion hole 351 may be formed at positions adjacent to each other. The first recess 340 and the second recess 350 may intersect each other. The first recess 340 and the second recess 350 may be disposed perpendicular to each other.

Accordingly, even when the sheet 40 is inserted into the first recess 340 while the sheet 40 is not in a correct position, the sheet 40 may be guided to the correct position, allowing the sheet 40 to be easily inserted into the first recess 340.

In addition, even when the header cover 50 is inserted into the second recess 350 while the header cover 50 is not in a correct position, the header cover 50 may be guided to the correct position, allowing the header cover to be easily inserted into the second recess 350.

Further, even when the sheet 40 compressed in one direction applies pressure to the header cover 50 while being stretched in another direction, the header cover 50 may be securely fixed to thereby achieve the structural stability.

Figure 5:
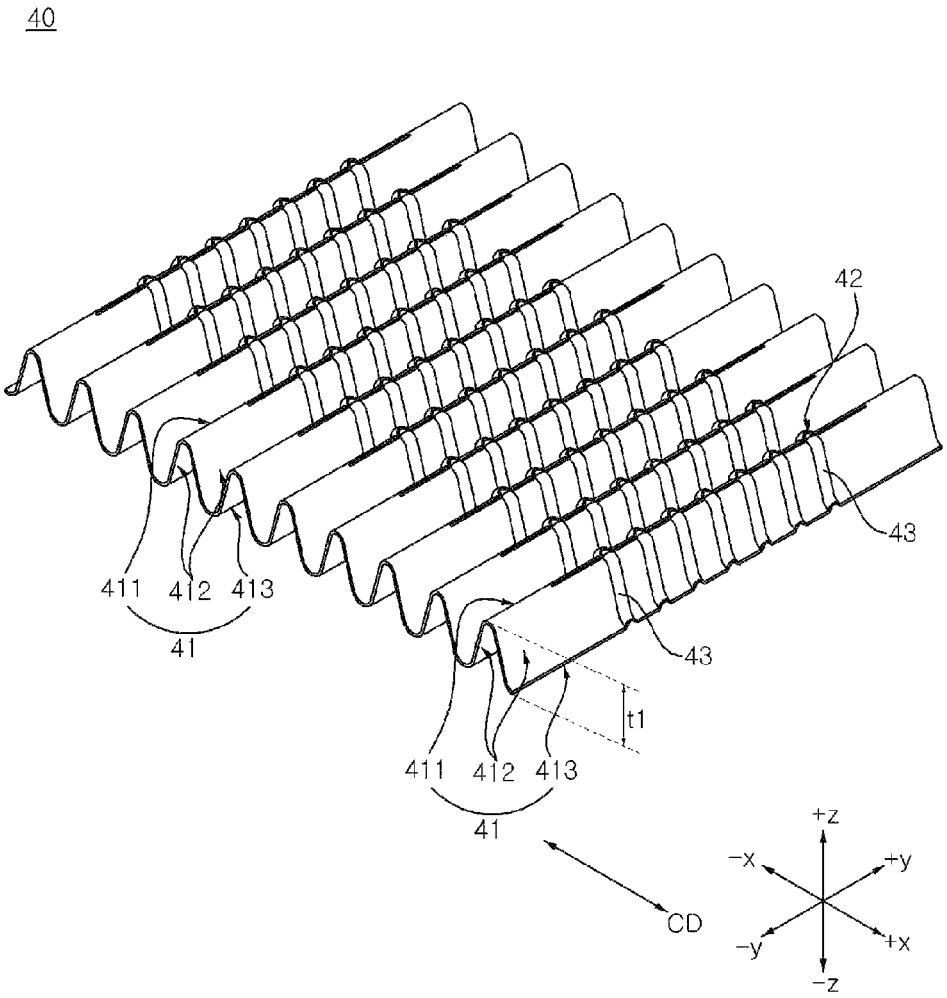
FIG. 5 is a perspective view of a sheet according to an embodiment of the present disclosure.
Figure 6:
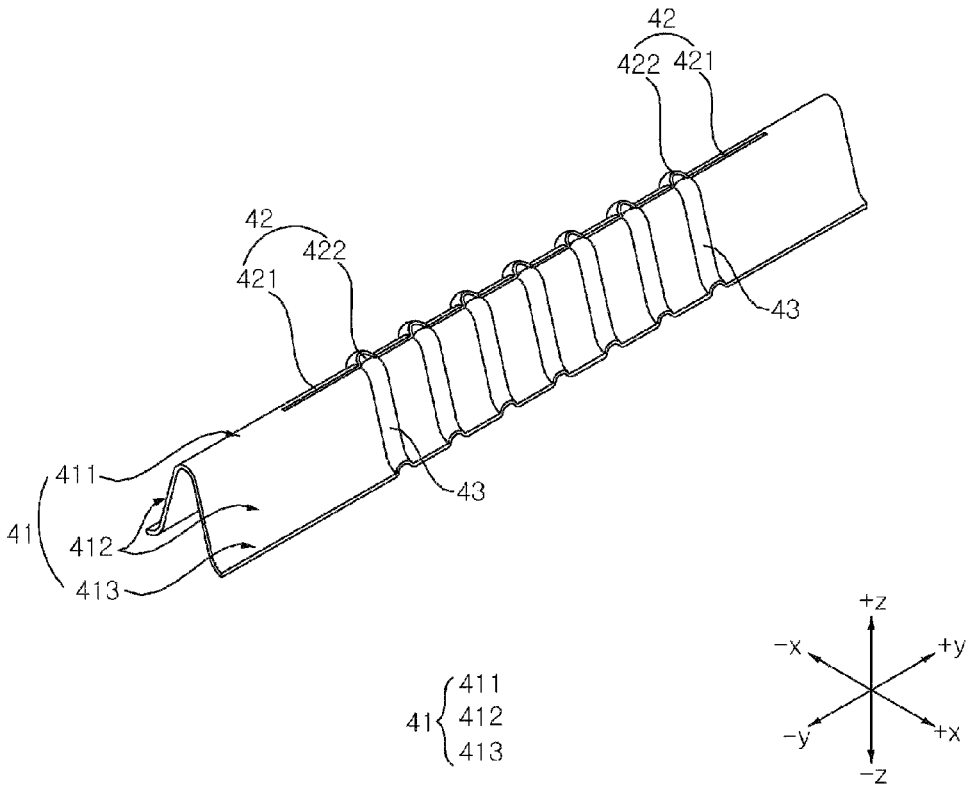
FIG. 6 is a view illustrating a portion of the sheet of FIG. 5.

Referring to FIGS. 5 and 6, the sheet 40 may be formed in a corrugated shape to define the plurality of corrugated portions 41. The plurality of corrugated portions 41 may include a plurality of crest portions 411 and a plurality of trough portions 413 alternately arranged with each other. The plurality of corrugated portions 41 may include a plurality of flat portions 412 formed at intervals between the plurality of crest portions 411 and the plurality of trough portions 413 in an inclined manner.

The crest portion 411 may extend in a direction perpendicular to the direction CD in which the plurality of corrugated portions 41 are arranged. The flat portion 412 may extend in a direction perpendicular to the direction CD in which the plurality of corrugated portions 41 are arranged. The trough portion 413 may extend in a direction perpendicular to the direction CD in which the plurality of corrugated portions 41 are arranged.

The fin tube 10 may be inserted into the slit 42 formed on the sheet 40. A plurality of slits 42 may be provided. The plurality of slits 42 may extend in a direction intersecting the direction CD in which the plurality of corrugated portions 41 are arranged. The plurality of slits 42 may extend perpendicular to the direction CD in which the plurality of corrugated portions 41 are arranged. The slit 42 may extend along the crest portion 411 and/or the trough portion 413.

The slit 42 may include a fin slit portion 421 into which the fin 101 (see FIG. 7) is inserted. The slit 42 may include a tube slit portion 422 into which the tube 102 (see FIG. 7) is inserted.

The fin slit portion 421 may be formed in a shape corresponding to the fin 101 of the fin tube 10. The fin slit portion 421 may have a thin slot shape. The fin slit portion 421 may have a width corresponding to a thickness of the fin 101. The fin slit portion 421 may extend along the crest portion 411 and/or the trough portion 413.

The tube slit portion 422 may be formed in a shape corresponding to the tube 102. For example, the tube slit portion 422 may have a circular shape. The tube slit portion 422 may have a diameter corresponding to the tube 102. A plurality of tube slit portions 422 may be arranged along the crest portion 411 and/or the trough portion 413. The plurality of tube slit portions 422 may be formed between fin slit portions 421. A width of the tube slit portion 422 may be greater than a width of the fin slit portion 421.

The slit 42 may be spaced inward from both ends of the sheet 40 by a predetermined distance. The fin slit portion 421 and the tube slit portion 422 may be alternately arranged in one direction.

The corrugated portion 41 of the sheet 40 may include a groove 43. The groove 43 may be configured to be in contact with the tube slit portion 422. The groove 43 may extend from the tube slit portion 422 along the corrugated shape of the sheet 40.

The groove 43 may be continuous in the front-and-rear direction from a crest portion 411, to a flat portion 412 and a trough portion 413 of a corrugated portion 41 among the plurality of corrugated portions 41, and to a crest portion 411 of an adjacent corrugated portion 41.

The groove 43 may have a shape in which the sheet 40 is recessed into a semicircular shape. The groove 43 may have a recessed shape to surround the tube 102 inserted into the tube slit portion 422 (see FIG. 10).

Accordingly, the fin tube 10 inserted into the slit 42 receives pressure in a direction in which the sheet 40 is compressed to thereby increase adhesion between the fin tube 10 and the sheet 40. As a result, airtightness may be achieved, refrigerant leakage may be prevented, and the structural stability may be ensured.

Figure 7:
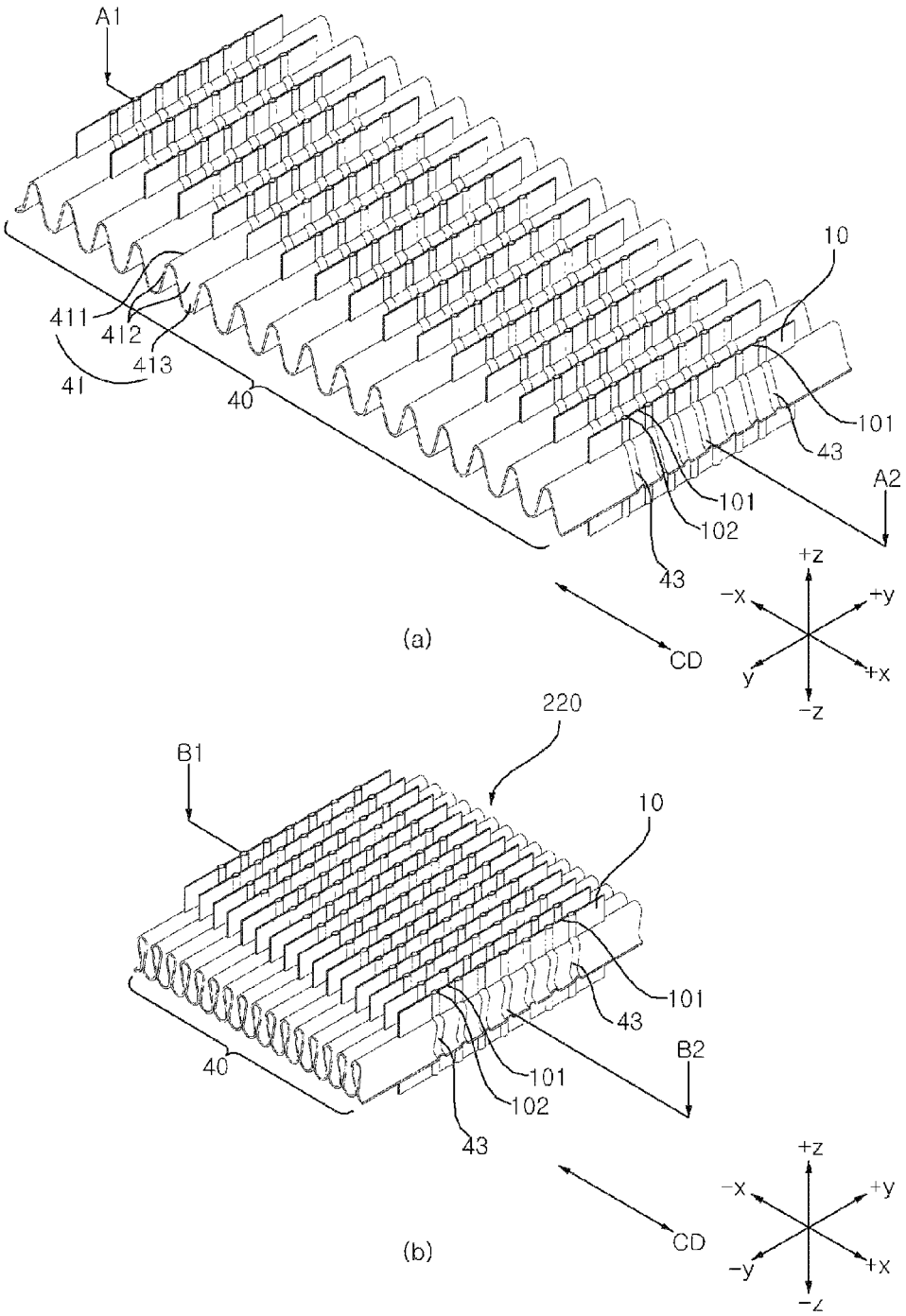
FIG. 7 is a perspective view illustrating the state before and after compressing a sheet according to an embodiment of the present disclosure. (a) of FIG. 7 illustrates the sheet before being compressed, and (b) of FIG. 7 illustrates the sheet after being compressed.
Figure 8:
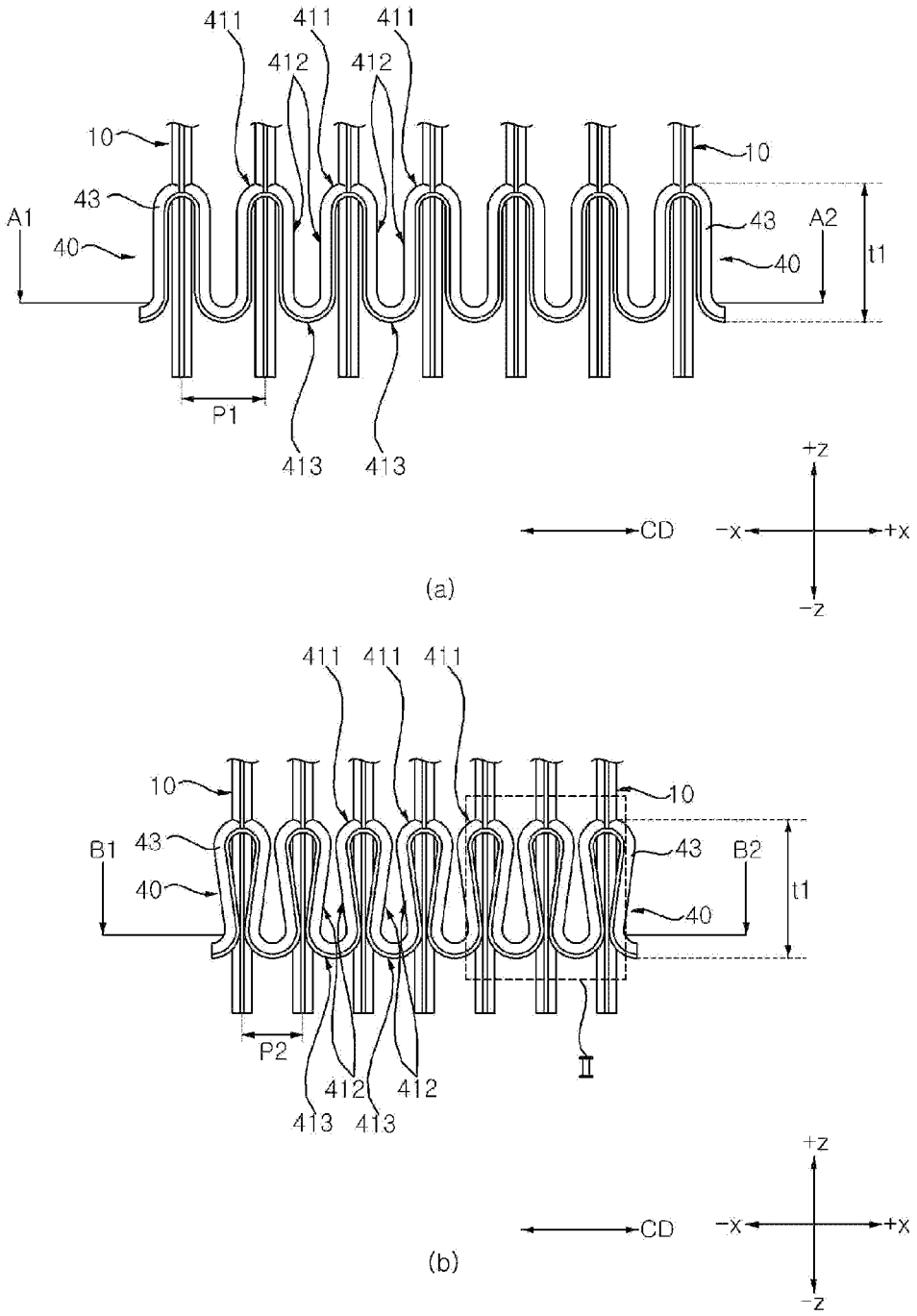
FIG. 8 is a side view illustrating the state before and after compressing a sheet according to an embodiment of the present disclosure. (a) of FIG. 8 illustrates a side portion of (a) of FIG. 7, and (b) of FIG. 8 illustrates a side portion of (b) of FIG. 7.

Referring to FIGS. 7 and 8, (a) of FIG. 7 and (a) of FIG. 8 illustrate the sheet 40 before being compressed, and (b) of FIG. 7 and (b) of FIG. 8 illustrate the sheet 40 after being compressed.

A pitch P2 between the plurality of corrugated portions 41 after the sheet 40 is compressed may be greater than a pitch P1 between the plurality of corrugated portions 41 before the sheet 40 is compressed.

A pair of flat portions 412 formed adjacent to the slit 42 may face opposite sides or surfaces of one end portion of the fin tube 10 inserted into the slit 42.

The one end portion of the fin tube 10 may be inserted at least as deep as the thickness t1 of the sheet 40. The one end portion of the fin tube 10 may be inserted more deeply than the thickness t1 of the sheet 40. The fin tube 10 inserted into the slit 42 formed in the crest portion 411 of the sheet 40 may protrude downward further than the trough portion 413.

Referring to (a) of FIG. 7 and (a) of FIG. 8, the fin tube 10 may be inserted into the sheet 40 in a stretched state before being compressed.

As the pitch P1 between the plurality of corrugated portions 41 is relatively wide, among the plurality of fin tubes 100, any one fin tube 10 and another fin tube 10 adjacent to the one fin tube 10 may be spaced apart by the pitch P1. Accordingly, each of the plurality of fin tubes 100 may be easily inserted into the sheet 40, thereby facilitating the assembly of the header 20 and the fin tube 10.

Referring to (b) of FIG. 7 and (b) of FIG. 8, the sheet 40 into which the fin tube 10 is inserted may be compressed in the direction CD in which the plurality of corrugated portions 41 are arranged. When the sheet 40 is compressed, a gap between the flat portion 412, which faces opposite sides or surfaces of the fin tube 10, and the fin tube 10 may be reduced.

As the pitch P2 between the plurality of corrugated portions is narrow, a gap between the fin tube 10 and the sheet 40 may be reduced, and as a filler metal is added to the gap, the quality of brazing may be improved.

Accordingly, the fin tube 10 inserted into the sheet 40 receives pressure from the sheet 40 in a direction in which the sheet 40 is compressed to thereby achieve the stability of the coupling structure.

Figure 9:
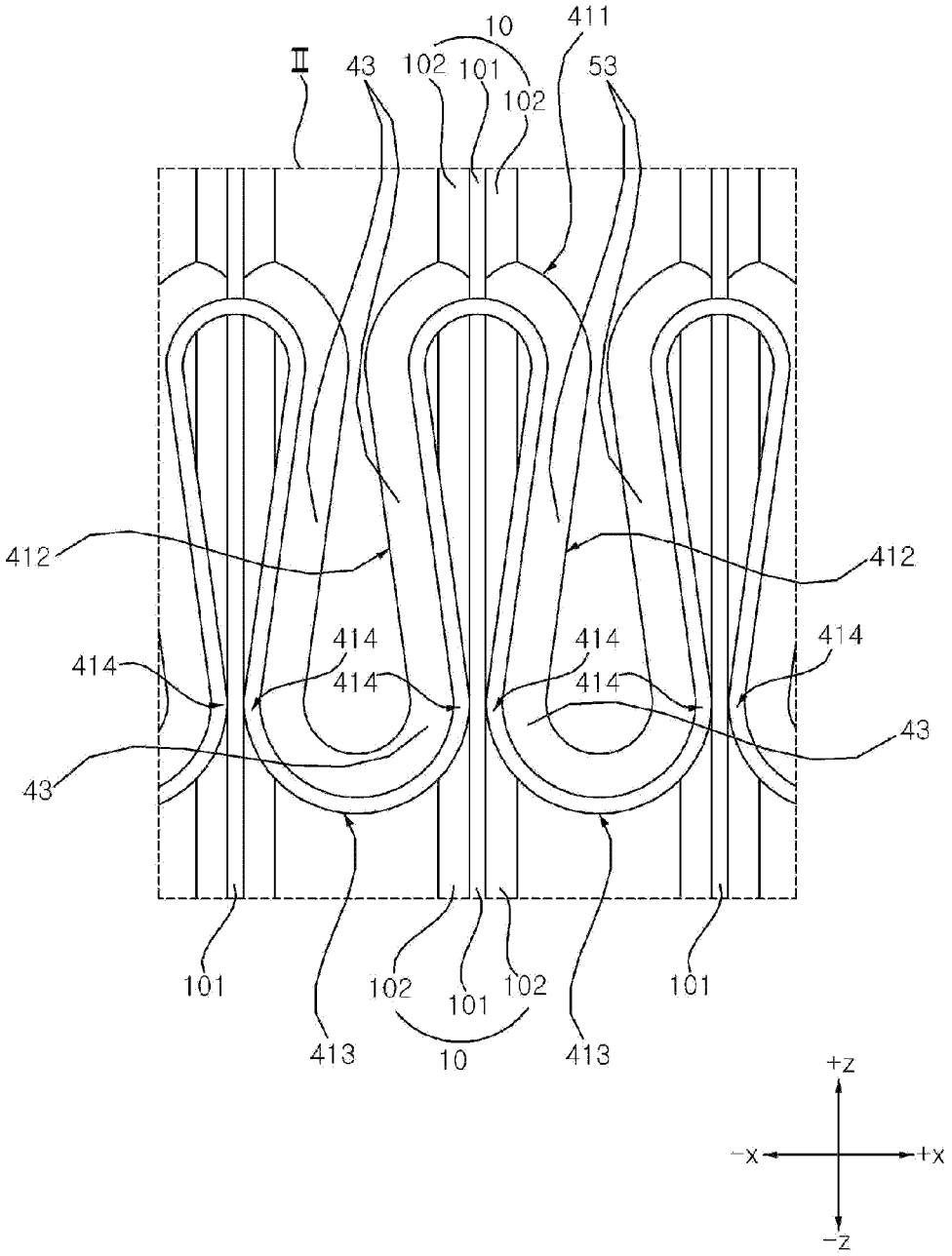
FIG. 9 is an enlarged view of a portion of (b) of FIG. 8.

Referring to FIG. 9, the slit 42 may be formed on the crest portion 411. A boundary portion 414 may be defined as a portion between the flat portion 412 and the trough portion 413.

When the sheet 40 is compressed, the boundary portion 414 may come in contact with one end portion of the fin tube 10 inserted into the slit 42. The boundary portion 414 may press both sides or surfaces of the fin tube 10.

Figure 10:
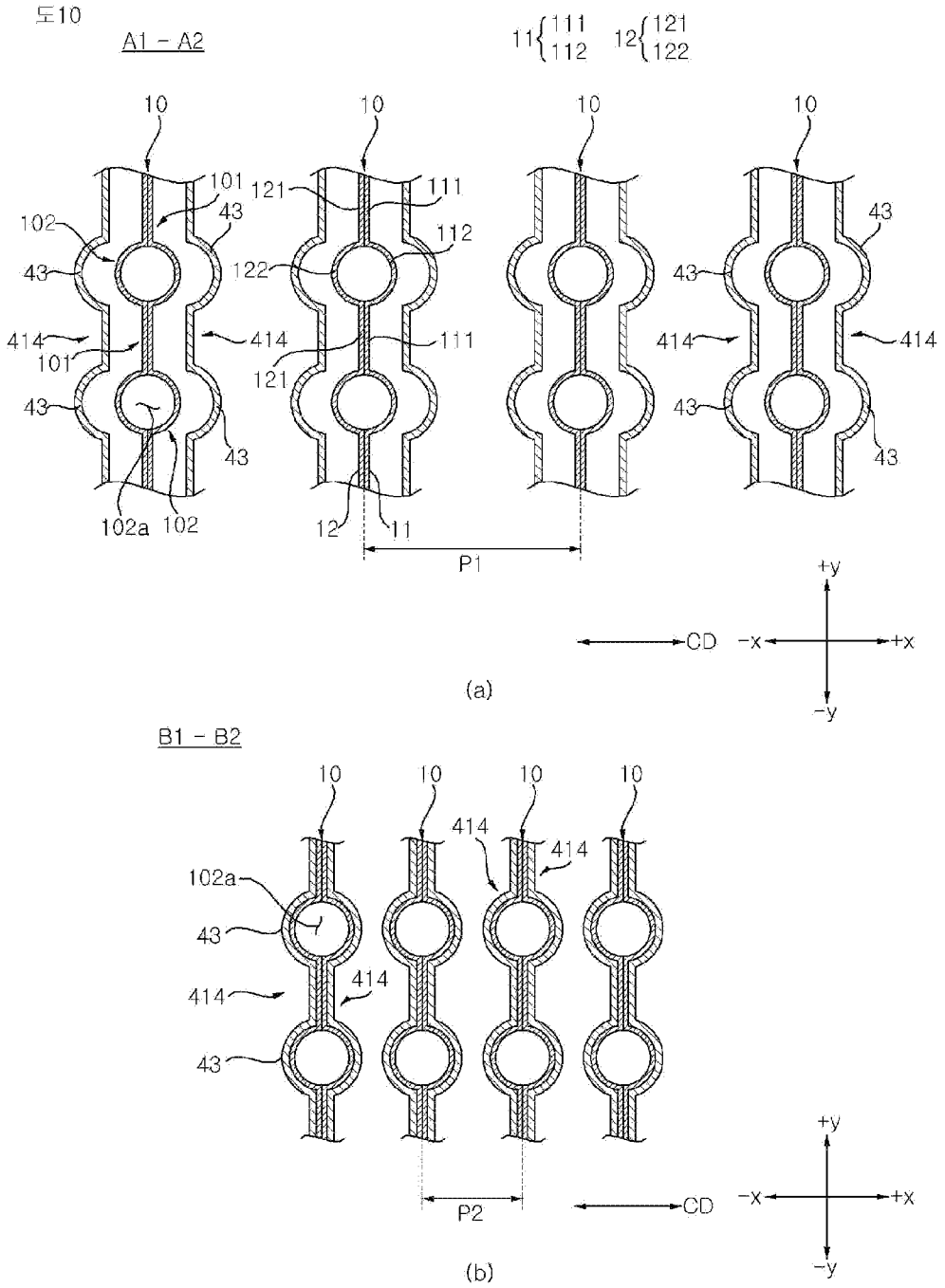
FIG. 10 is a cross-sectional view cut along the incision line of FIGS. 7 and 8 and seen from above. (a) of FIG. 10 is a view cut along the line A1-A2 of (a) of FIG. 7 and (a) of FIG. 8, and (b) of FIG. 10 is a view cut along the line B1-B2 of (b) of FIG. 7 and (b) of FIG. 8.
Figure 11:
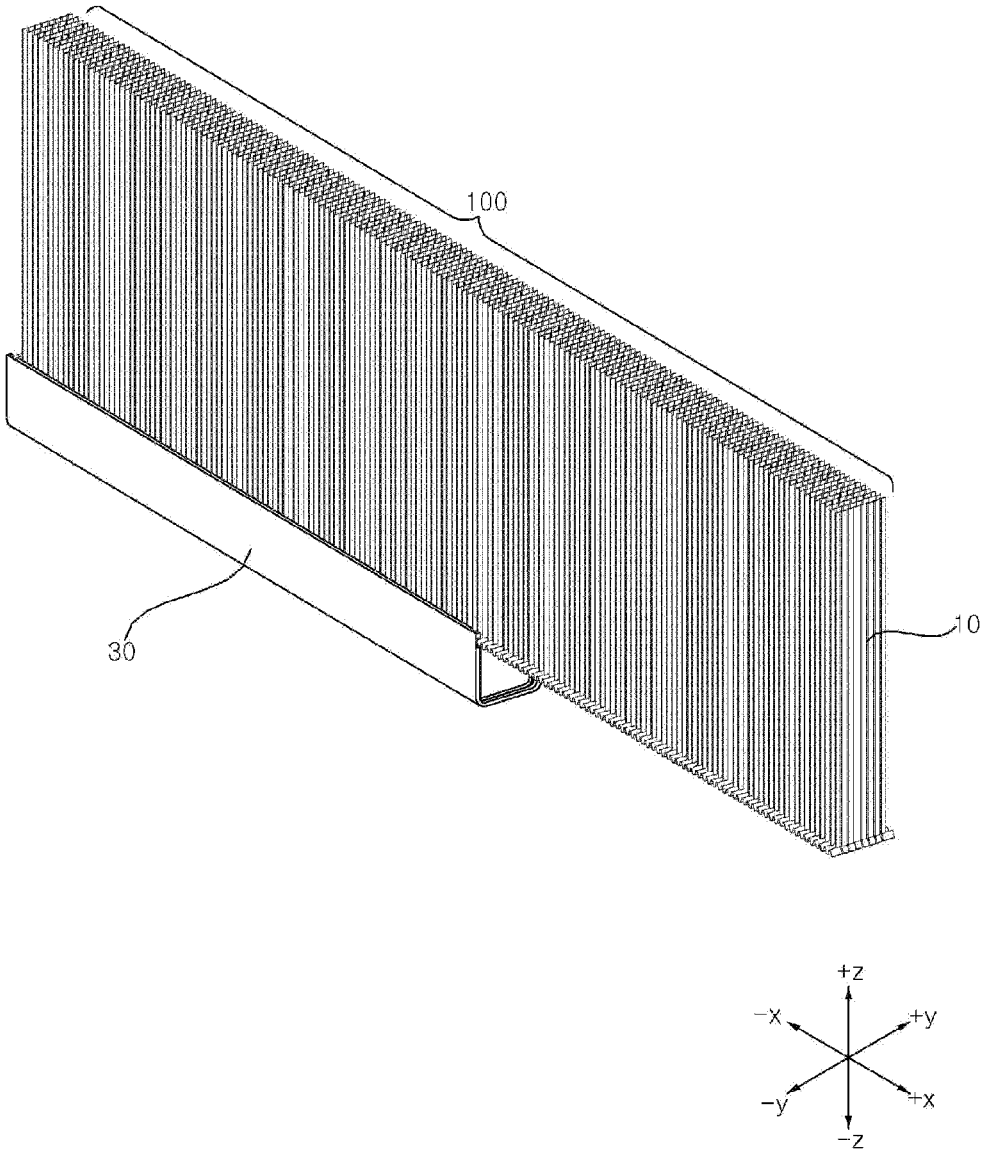
FIGS. 11 to 13 illustrate a sequence of steps in a method of manufacturing a heat exchanger according to an embodiment of the present disclosure.
Figure 12:
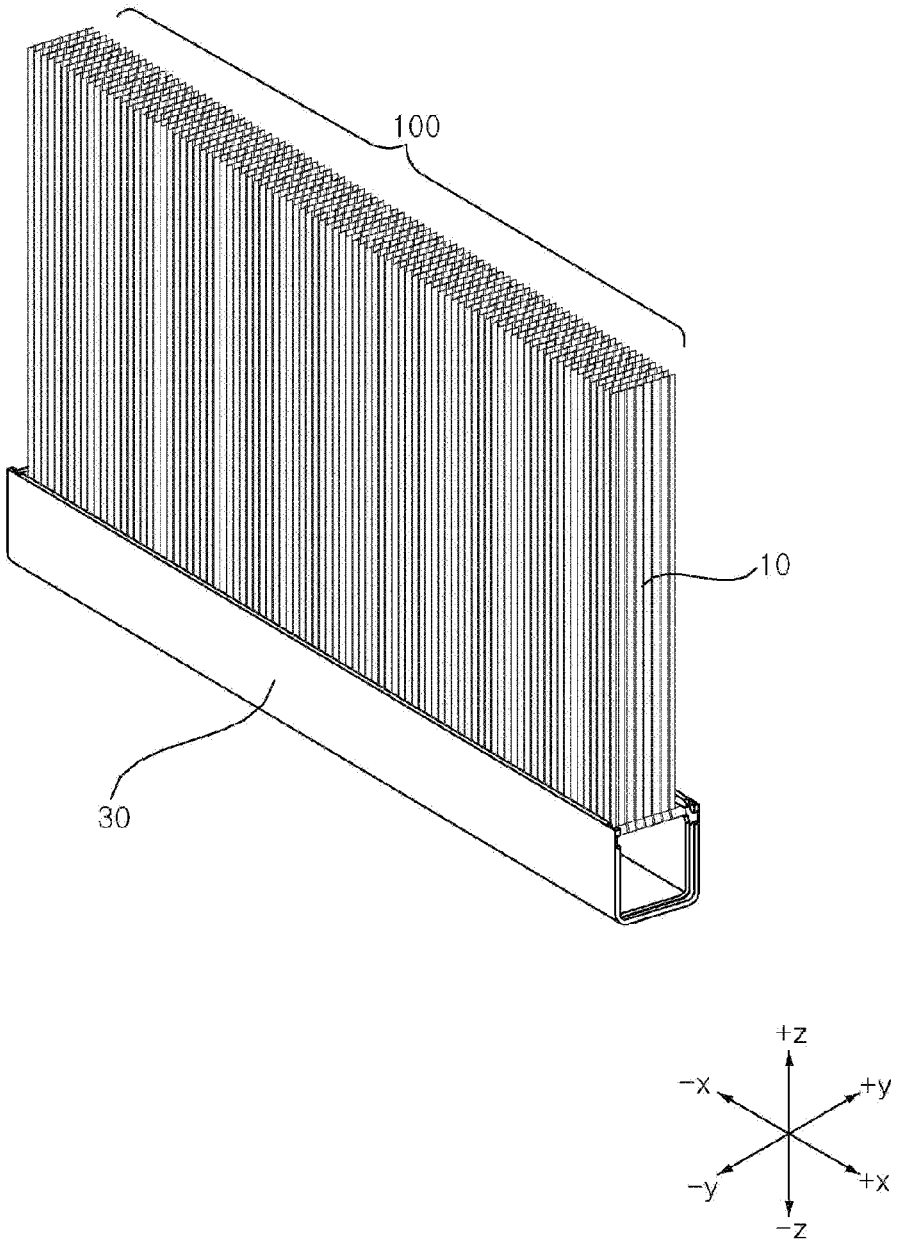
Figure 13:
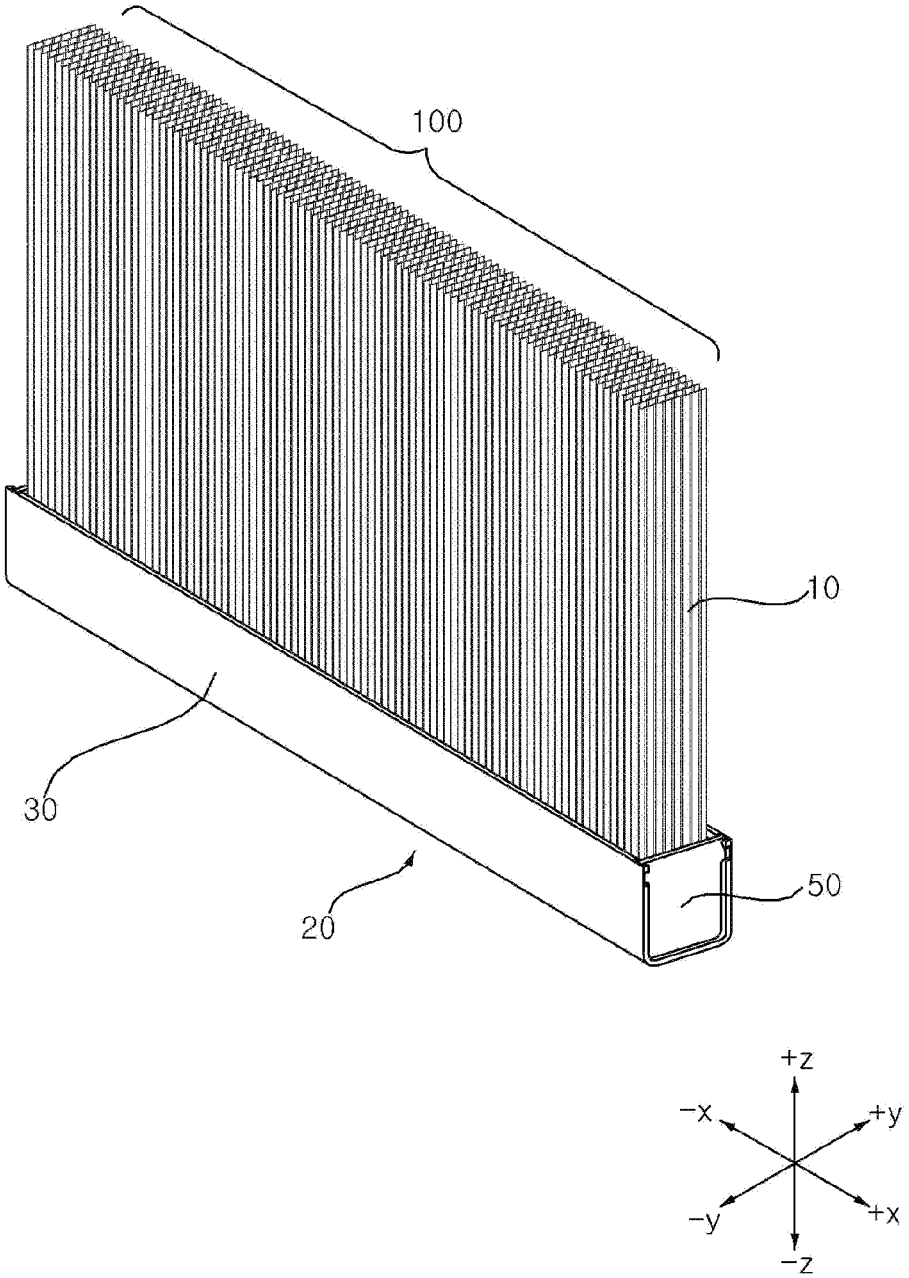
Figure 14:
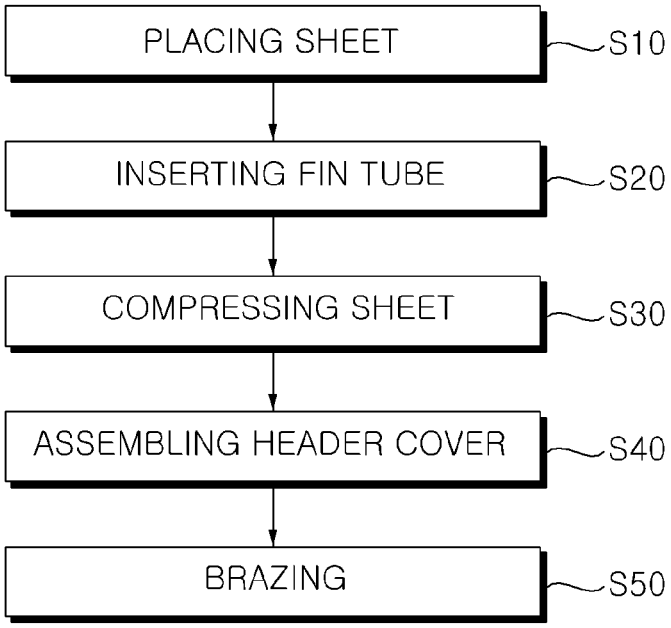
FIG. 14 is a block diagram illustrating a method of manufacturing a heat exchanger according to an embodiment of the present disclosure.

Referring to FIG. 10, (a) of FIG. 10 illustrates the sheet 40 before being compressed, and (b) of FIG. 10 illustrates the sheet 40 after being compressed. A first plate 11 and a second plate 12 may be coupled to each other to define the fin tube 10. An inner surface of the first plate 11 and an inner surface of the second plate 12 may be coupled to each other to define the fin 101 and the tube 102 of the fin tube 10. A tube hole 102*a* through which refrigerant flows may be formed in the tube 102.

The first plate 11 may include a first flat portion 111 formed at a position corresponding to the fin 101 and a first tube portion 112 formed at a position corresponding to the tube 102. The first flat portion 111 and the first tube portion 112 may extend in one direction, and may each be provided in plurality to be alternately arranged with each other. The first tube portion 112 may have a semicircular cross section.

The second plate 12 may include a second flat portion 121 formed at a position corresponding to the fin 101 and a second tube portion 122 formed at a position corresponding to the tube 102. The second flat portion 121 and the second tube portion 122 may extend in one direction, and may each be provided in plurality to be alternately arranged with each other. The second tube portion 122 may have a semicircular cross section.

The first flat portion 111 and the second flat portion 121 may be coupled to be in contact with each other to define the fin 101. In addition, the first tube portion 112 and the second tube portion 122 may be coupled to be in contact with each other to define the tube 102 having the tube hole 102*a*.

When the sheet 40 is compressed, the boundary portion 414 may come in contact with the fin 101. When sheet 40 is compressed, the boundary portion 414 may come in contact with tube 102. The boundary portion 414 may press both sides or surfaces of the fin tube 10. The boundary portion 414 may press the first plate 11 and the second plate 12 in a direction in which the first plate 11 and the second plate 12 are coupled to each other. The groove 43 formed in the boundary portion 414 may be in close contact with the tube 102.

Accordingly, the structural stability of the fin tube 10 and the header 20 against internal pressure due to the flow of refrigerant may be achieved, and a gap between the coupling structures may be narrowed to thereby reduce the brazing defect rate and prevent refrigerant leakage.

Referring to FIGS. 11 to 14, a method of manufacturing the heat exchanger according to the present disclosure may include: placing a sheet 40 having a plurality of slits 42 (see FIG. 5) on one open side of a header body 30 to be longer than a length of the header body 30 (S10); inserting one end portion of a fin tube 10 into each of the plurality of slits 42 of the sheet 40 (S20); and compressing a corrugated portion 41 of the sheet 40 in a longitudinal direction of the header body 30 to allow the sheet 40 to be drawn into the header body 30 (S30). The order of the step S10 and the step S20 may be interchanged.

In addition, coupling the header cover 50 to one side surface portion of the header body 30 (S40) may be further included to hermetically seal the header 20 from the outside.

Also, brazing a gap between the compressed sheet 40 and the fin tube 10 with a filler metal (S50) may be further included.

Although preferred embodiments of the present disclosure have been shown and described herein, the present disclosure is not limited to the specific embodiments described above. It will be understood that various modifications and changes can be made by those skilled in the art without departing from the idea and scope of the present disclosure as defined by the appended claims. Therefore, it shall be considered that such modifications, changes, and equivalents thereof are all included within the scope of the present disclosure.

The invention claimed is:

1. A heat exchanger comprising:

a plurality of fin tubes, each of the plurality of fin tubes comprising a fin and a tube defining a passage through which refrigerant flows, and the fin and the tube for each of the plurality of fin tubes being integrally formed; and a header coupled to ends of the plurality of fin tubes, wherein the header comprises:

a header body having an open side; and a sheet provided on the open side of the header body, having a plurality of slits into which the ends of the plurality of fin tubes are respectively inserted, and bent into a corrugated shape to define a plurality of corrugated regions, and wherein one of the plurality of slits comprises:

a fin slit section into which the fin is inserted; and a tube slit section into which the tube is inserted.

2. The heat exchanger of claim 1, wherein the plurality of slits extend in a first direction intersecting a second direction in which the plurality of corrugated regions are provided, and wherein the ends of the plurality of fin tubes are inserted to a depth that is at least a thickness of the sheet.

3. The heat exchanger of claim 1, wherein the plurality of corrugated regions comprise:

a plurality of crest regions and a plurality of trough regions alternately provided with each other; and a plurality of inclined flat regions formed at intervals between the plurality of crest regions and the plurality of trough regions, and wherein the plurality of slits extend along at least one of the plurality of crest regions or the plurality of trough regions.

4. The heat exchanger of claim 3, wherein a pair of the flat regions, formed adjacent to a slit among the plurality of slits, face opposite surfaces of the end of one of the plurality of fin tubes inserted into the slit.

5. The heat exchanger of claim 3, wherein each of the plurality of slits is formed on one of the plurality of crest regions, and wherein, areas between the trough regions and of the flat regions are defined as boundary regions, and one of the boundary regions is in contact with the end of one of the plurality of fin tubes inserted into one of the plurality of slits.

6. The heat exchanger of claim 3, wherein the sheet is configured such that the plurality of corrugated are compressible in a direction in which the plurality of corrugated regions are provided, and wherein a pitch between an adjacent pair of the plurality of trough region decreases when the sheet is compressed.

7. The heat exchanger of claim 1, wherein the sheet comprises a groove extending from the tube slit section along the corrugated shape of the sheet and recessed to at least one of surround or contact one of the tubes inserted into the tube slit section.

8. The heat exchanger of claim 1, wherein the header body includes a first recess recessed from an inner surface thereof to extend in a first direction and configured to guide insertion of the sheet in the first direction.

9. The heat exchanger of claim 8, wherein the plurality of corrugated regions are provided in the first direction.

10. The heat exchanger of claim 8, wherein the first recess comprises:

a sheet insertion hole connected to an outside and configured to allow the sheet to be inserted from the outside; and a sheet guide recess extending from the sheet insertion hole in the first direction and configured to guide insertion of the sheet.

11. The heat exchanger of claim 10, wherein the sheet insertion hole has a shape that gradually narrows in a direction in which the sheet is inserted.

12. The heat exchanger of claim 8, wherein the header comprises a header cover coupled to an end of the header body to be in contact with an end of the sheet.

13. The heat exchanger of claim 12, wherein the plurality of corrugated regions are provided in a first direction, and wherein the header body includes a second recess recessed from an inner surface thereof to extend in a second direction and configured to guide insertion of the header cover in the second direction.

14. The heat exchanger of claim 13, wherein a side surface and a lower surface of the header cover extend in the second direction, and wherein the header cover comprises a cover edge region formed between the side surface and the lower surface of the header cover and having a rounded shape from the lower surface of the header cover to the side surface of the header cover.

15. The heat exchanger of claim 13, wherein the second recess comprises:

a cover insertion hole connected to an outside and configured to allow the header cover to be inserted from the outside; and a cover guide recess extending from the cover insertion hole in the second direction and configured to guide insertion of the header cover.

16. The heat exchanger of claim 1, further comprising a filler metal provided in a gap between the sheet and each fin tube.

* * * * *